United States Patent [19]

Spaeder

[11] 3,970,483

[45] July 20, 1976

[54] NORMALIZED ALLOY STEEL FOR USE AT ELEVATED TEMPERATURE

[75] Inventor: Gerald J. Spaeder, Monroeville, Pa.

[73] Assignee: United States Steel Corporation, Pittsburgh, Pa.

[22] Filed: July 23, 1975

[21] Appl. No.: 598,299

[52] U.S. Cl. ..... 148/36; 75/126 C; 75/126 E; 75/126 F

[51] Int. Cl.[2] ..... C22C 38/22; C22C 38/24; C22C 38/26

[58] Field of Search ..... 148/36; 75/126 C, 126 E, 75/126 F

[56] References Cited

UNITED STATES PATENTS

| | | | |
|---|---|---|---|
| 2,158,651 | 5/1939 | Becket | 75/128 G X |
| 3,010,822 | 11/1961 | Altenburg | 75/126 F X |
| 3,328,211 | 6/1967 | Nakamura | 75/126 F X |
| 3,725,049 | 4/1973 | Satoh | 75/126 F X |
| 3,761,324 | 9/1973 | Elias | 75/126 F X |

*Primary Examiner*—Arthur J. Steiner
*Attorney, Agent, or Firm*—Forest C. Sexton

[57] ABSTRACT

A normalized, silicon-killed steel for service at temperatures up to about 1000°F containing:

0.15 to 0.21% carbon
0.70 to 1.0% manganese
0.15 to 0.30% silicon
0.40 to 0.65% chromium
0.45 to 0.60% molybdenum
0.05 to 0.10% vanadium
0.01 to 0.10% columbium

2 Claims, No Drawings

NORMALIZED ALLOY STEEL FOR USE AT ELEVATED TEMPERATURE

One prior art steel currently available commercially for high temperature applications is a normalized silicon-killed steel containing about 0.15 to 0.21% carbon, 0.70 to 1.0% manganese, 0.40 to 0.65% chromium, 0.45 to 0.60% molybdenum, and 0.05 to 0.10% vanadium. This hot rolled steel, normalized at a temperature of 1550° to 1650°F is characterized by a stable ferrite-bainite microstructure having good notch toughness and good stress rupture ductility at temperature up to 1000°F. On the other hand, this steel does suffer one disadvantage in having a relatively narrow normalizing temperature range of 1550° to 1650°F. A small increase in the ideal normalizing temperature can result in a major change in the final microstructure, i.e. from the desired ferrite-bainite microstructure, to a completely bainitic microstructure. The completely bainitic microstructure is undesirable because the toughness thereof is considerably lower than the two-phase ferrite-bainite microstructure. The reason for the change in microstructure, i.e. the elimination of proeutectoid ferrite, is that a relatively small increase in normalizing temperature substantially increases the austenite grain size with a concomitant increase in the hardenability of the steel. Thus, the proeutectoid ferrite reaction is suppressed and the completely bainitic microstructure is formed.

It is known that the addition of a small amount of aluminum, about 0.04%, to the silicon-killed Cr-Mo-V steel will result in an increase in the grain coarsening temperature of the austenite and, therefore broaden the permissible normalizing temperature. With such an aluminum addition, therefore, the desired microstructure can be more easily achieved without the need for exacting temperature controls. Nevertheless, the aluminum containing version has not been successful commercially because the aluminum addition also results in a deterioration of the notch toughness of the steel as measured by Charpy V-notch impact tests. In addition, the stress rupture elongation at elevated temperatures is reduced and deteriorates with increasing time, indicating that the aluminum containing steel may embrittle during service at elevated temperatures.

It is an object of this invention to provide a new and improved silicon-killed Cr-Mo-V steel for high temperature service which has a broader normalizing temperature range.

Another object of this invention is to provide a silicon-killed Cr-Mo-V steel for high temperature service which contains a small addition of columbium to increase the grain coarsening temperature of the austenite and therefore permit better control of the resultant microstructure upon normalizing.

A further object of this invention is to provide a silicon-killed Cr-Mo-V steel for high temperature service which is modified to increase the austenite grain coarsening temperature without causing any deterioration in the steels mechanical properties.

This invention is predicated upon any discovery that the addition of a small amount of columbium to the conventional silicon-killed Cr-Mo-V high temperature steel will significantly broaden the permissible normalizing temperature to thus assure microstructural stability in the normalized steel. Unlike aluminum, columbium does not in any way adversely affect the steel's mechanical properties. The amount of columbium required is small, being within the range 0.01 to 0.1%, and ideally about 0.03%. The inventive alloy can readily be normalized to produce the desired two-phase microstructure, i.e. ferrite-bainite, at any temperature within the range 1550° to 1800°F.

It should be understood of course that normalizing is a heat treatment requiring that the steel be heated sufficiently to austenitize the entire microstructure, and then cooled in still air at ambient temperatures. It is common practice to refer to the heating temperature as the "normalizing" temperature.

As previously noted, the desired microstructure is a two-phase structure of ferrite and bainite. Although the relative amounts of each is not critical, ideally they should be present in approximately equal amounts by volume. Nevertheless, good properties can be achieved as long as there is a significant amount of each, i.e. no less than about 20 to 25% of that phase present in the smallest amount.

To illustrate the advantages of this invention three experimental heats were prepared, the first a conventional prior art Cr-Mo-V steel, the second a prior art Cr-Mo-V steel with aluminum and the third a Cr-Mo-V steel containing columbium according to this invention. The compositions of the three steels is shown in Table I.

TABLE I

| Steel | C | Mn | P | S | Si | Cr | Mo | V | Al | Cb |
|---|---|---|---|---|---|---|---|---|---|---|
| Cr—Mo—V | 0.19 | 0.99 | 0.021 | 0.028 | 0.23 | 0.59 | 0.52 | 0.07 | 0.002 | — |
| Cr—Mo—V—Al | 0.18 | 0.84 | 0.020 | 0.022 | 0.31 | 0.58 | 0.51 | 0.08 | 0.04 | — |
| Cr—Mo—V—Cb | 0.20 | 0.90 | 0.017 | 0.021 | 0.25 | 0.58 | 0.51 | 0.08 | 0.001 | 0.03 |

All steels were identically processed except for the additions of aluminum and columbium, silicon-killed according to conventional practices, and identically processed to ½-inch hot rolled plate and normalized at 1600°F. Metallographic examination showed that all steel did attain the desired microstructure. Samples of the three steels were then tested for notch toughness, stress rupture ductility and tensile properties. The results of these tests are shown in Tables II, III and IV below.

TABLE II

| Steel | Test Temperature F | Energy Absorption ft-lb | Fracture Appearance, % Shear | Lateral Expansion, mils |
|---|---|---|---|---|
| Cr—Mo—V | 78 | 42 | 50 | 38 |
| Cr—Mo—V—Al | 78 | 14 | 20 | 11 |

TABLE II-continued

| Steel | Test Temperature F | Energy Absorption ft-lb | Fracture Appearance, % Shear | Lateral Expansion, mils |
|---|---|---|---|---|
| Cr—Mo—V—Cb | 78 | 25 | 35 | 25 |

TABLE III

| Steel | Test Temp. F | Applied Stress, ksi | Time to Rupture, hours | Elongation in 1 inch, % |
|---|---|---|---|---|
| Cr—Mo—V | 950 | 65 | 352 | 28 |
| | | 60 | 661 | 27 |
| | | 55 | 1340 | 24 |
| | | 50 | 3664 | 23 |
| | | 40 | 6753 | 24 |
| Cr—Mo—V—Al | 950 | 65 | 583 | 13 |
| | | 60 | 1603 | 8 |
| | | 55 | 3642 | 8 |
| Cr—Mo—V—Cb | 950 | 70 | 226 | 27 |
| | | 65 | 548 | 27 |
| | | 60 | 934 | 26 |
| | 1050 | 35 | 343 | 31 |
| | 1100 | 20 | 467 | 42 |

TABLE IV

| Steel | Test Temperature, F | Yield Strength (0.2% Offset) ksi | Tensile Strength ksi | Elongation in 1 inch % | Reduction of Area % |
|---|---|---|---|---|---|
| Cr—Mo—V | 75 | 63.9 | 101 | 24.2 | 63.8 |
| Cr—Mo—V—Cb | 75 | 63.0 | 104 | 23.5 | 62.2 |
| Cr—Mo—V | 950 | 50.6 | 82.3 | 28.0 | 79.6 |
| Cr—Mo—V—Cb | 950 | 62.0 | 81.4 | 28.5 | 77.1 |
| (Cr—Mo—V—Al not tested) | | | | | |

In other tests, it was shown that the inventive steel could readily be normalized at any temperature within the range 1550° to 1800°F without significant differences in microstructure and resultant properties.

I claim:

1. A silicon-killed alloy steel suitable for high temperature applications up to about 1000°F consisting of:

0.15 to 0.21% carbon
0.70 to 1.0% manganese
0.15 to 0.30% silicon
0.40 to 0.65% chromium
0.45 to 0.60% molybdenum
0.05 to 0.10% vanadium
0.01 to 0.10% columbium and a balance essentially of iron and normal residual impurities, said steel normalized at a temperature of from 1550° to 1800°F and having a two-phase microstructure of ferrite and bainite.

2. A silicon-killed alloy steel according to claim 1 in which said columbium content is about 0.03%.

* * * * *